US006845701B2

(12) United States Patent
Drackett

(10) Patent No.: US 6,845,701 B2
(45) Date of Patent: Jan. 25, 2005

(54) MOBILE BULLETPROOF PERSONNEL SHIELD

(76) Inventor: John W. Drackett, 1501 E. Amelia St., Orlando, FL (US) 32803

( * ) Notice: Subject to any disclaimer, the term of this patent is extended or adjusted under 35 U.S.C. 154(b) by 0 days.

(21) Appl. No.: 10/631,112

(22) Filed: Jul. 30, 2003

(65) Prior Publication Data

US 2004/0255769 A1 Dec. 23, 2004

Related U.S. Application Data

(60) Provisional application No. 60/399,921, filed on Aug. 1, 2002.

(51) Int. Cl.[7] ..... F41H 5/14
(52) U.S. Cl. ..... 89/36.09
(58) Field of Search ..... 89/36.06, 36.07, 89/36.08, 36.09, 36.14, 36.15

(56) References Cited

U.S. PATENT DOCUMENTS

| | | | | |
|---|---|---|---|---|
| 1,253,964 A | | 1/1918 | Hack | |
| 1,267,588 A | | 5/1918 | Poniatowski | |
| 1,274,645 A | | 8/1918 | Wasylowich | |
| 1,281,400 A | | 10/1918 | Larnell | |
| 1,304,541 A | | 5/1919 | Clark | |
| 1,308,286 A | | 7/1919 | Korn | |
| 2,209,654 A | | 7/1940 | Loeser, Jr. | |
| 2,372,043 A | * | 3/1945 | Aghnides | 180/6.44 |
| 2,722,986 A | * | 11/1955 | Baldine | 180/6.7 |
| 2,823,393 A | * | 2/1958 | Baldine | 5/652 |
| 3,942,598 A | * | 3/1976 | Council | 180/6.5 |
| 4,192,216 A | | 3/1980 | Wait | |
| 4,245,546 A | * | 1/1981 | Chaires | 89/36.09 |
| 4,781,101 A | * | 11/1988 | Zevuluni et al. | 89/36.09 |
| 5,370,035 A | * | 12/1994 | Madden, Jr. | 89/36.08 |
| 6,711,980 B2 | * | 3/2004 | Kropf | 89/36.09 |

FOREIGN PATENT DOCUMENTS

| | | | | |
|---|---|---|---|---|
| AT | OE 67639 | * | 1/1915 | 89/36.09 |
| IT | 329289 | * | 9/1936 | 89/36.09 |

OTHER PUBLICATIONS

N.Y. Tribune; The Boomerang Sniping Post; Nov. 3, 1918; one page.*

* cited by examiner

*Primary Examiner*—Stephen M. Johnson
(74) *Attorney, Agent, or Firm*—William M. Hobby, III

(57) ABSTRACT

A mobile personnel gunfire shield apparatus has a frame supported on a pair of large wheels. The frame has a bullet resistant window mounted therein and is covered with flexible ballistic shield material, such as woven Kevlar, removably attached to the frame. A movable gun mount is mounted to the frame front adjacent the window mounted therein and has a gun having a barrel removably mounted thereto with the barrel extending through an opening in the front of the flexible ballistic shield material which allows a person to move the gunfire shield while protecting the occupant from gunfire and simultaneously operate the gun from thereinside.

12 Claims, 3 Drawing Sheets

MOBILE BULLETPROOF PERSONNEL SHIELD

This application claims priority from provisional application 60/399,921, filed on Aug. 1, 2002.

BACKGROUND OF THE INVENTION

The present invention generally relates to a mobile bullet resistant personnel shield and especially to a hand maneuverable wheeled bullet resistant shield for use by security forces, police, militia and by the military to protect individuals from gunfire.

Police and security forces all over the world are confronted with the problem of controlling crowds and demonstrations which at times become violent. The military is faced with protecting military personnel from bullets and shrapnel while in exposed positions. Wars, insurrections, riots, and police actions of various kinds often involve small arms fire and projectiles in which people are often injured or wounded while in an exposed position. Security forces typically have at their disposal helmets, billy sticks, and hand-held protective shields. These have not always been found satisfactory when crowds become very large or exceedingly aggressive and throw objects, such as bottles and stones, and in the face of shots from small arms. Police and militia often also are faced with buildings having one or more individuals having small arms taking refuge in the buildings and are required to cross an open area to approach the building.

In the past, there have been a number of designs for portable shields having gun ports and the like which could be used to provide an offensive or defensive stronghold that could accommodate several people and protect such people from gunfire at least from a frontal direction. Some examples of these type of shields can be seen in the following U.S. Patents: Chaires U.S. Pat. No. 4,245,546; Zevuluni et al., U.S. Pat. No. 4,781,101; Loeser, Jr., U.S. Pat. No. 2,209,654; Korn, U.S. Pat. No. 1,308,286; Hack, U.S. Pat. No. 1,253,964; Wait, U.S. Pat. No. 4,192,216; Wasylowich, U.S. Pat. No. 1,274,645; Poniatowski, U.S. Pat. No. 1,267,588; Larnell, U.S. Pat. No. 1,281,400; and Clark, U.S. Pat. No. 1,304,541. The invention of ballistic fiber, such as Dupont's Kevlar, made possible modern body armor that is worn by law enforcement officers and military personnel. The lives of more than 2,000 police officers have been saved by wearing soft flexible body armor that covers the torso. Type II body armor is designed to protect against 9 mm, 0.357 magnum, and 0.45 Auto. Although the layers of fiber are able to prevent most bullets fired from pistols from penetrating, the impact of the projectile causes the fabric to bend inward against the body, creating blunt trauma injuries. Blunt trauma injuries in areas near vital organs can be a serious or even life threatening problem. Body armor designed to protect against higher threat levels, such as 12 gauge rifled slugs and high powered rifles, is very cumbersome and is not worn on a day to day basis by police officers. In addition to this limitation, the body armor usually worn by police officers offers no protection at all for the head, neck, arms and legs.

Almost every public building in America complies with handicap access laws. In the event of a terrorist threat or shooting incident, an operator using this shield will be able to rapidly and safely move throughout schools, shopping malls, government buildings or airports using existing wheelchair ramps. It will also be possible to travel in elevators to secure buildings floor by floor. We are not aware of any other design that offers such a high degree of protection and mobility. The handheld shields used by SWAT teams are mobile, but offer no protection from attacks on either side, overhead or from frontal attacks to the legs. Currently, there is a huge gap between these handheld shields, and heavy, massive armored vehicles that can not move through a small alley, a wooded area, between parked cars or enter a building. The shield does not use any type of motor or electronics and so is reliable and requires very little maintenance.

The device described herein uses ballistic fabric stretched over a light metal frame on wheels. This arrangement is highly mobile, offers head to toe protection and eliminates the problem of blunt trauma. This design has several distinct advantages. Unlike other designs that employ curved metal, the ballistic fabric covering will not cause bullets to ricochet off the surface, an extremely dangerous situation. Another advantage is that ballistic material is resistant to fire. The shield will provide considerable protection against burning debris. Perhaps most important, the lightweight and large wheels will allow the operator to move at running speed across parking lots, down narrow alleys and even inside buildings, such as shopping malls, schools, and airport terminals. Because there are only two wheels that move independently of each other, the shield has a zero degree turning radius.

This invention relates to improvements in mobile shields for protection against gunfire, shrapnel and other projectiles which use a ballistic fabric stretched over a light metal frame and wheels.

SUMMARY OF THE INVENTION

A mobile personnel gunfire shield apparatus has a frame having base, top, front, and side portions. A pair of large wheels are attached to the frame base with a wheel axle. A plurality of sheets of flexible ballistic shield material, such as woven Kevlar, is removably attached to the frame to cover the front and top and at least two sides. A transparent bullet resistant window is mounted to the frame front and one or more bullet resistant windows are added to the top of the frame and surrounded by sheets of flexible ballistic shield material. A movable gun mount is mounted to the frame front adjacent the window mounted therein and has a gun having a barrel removably mounted thereto, such as with a pair of clamps, with the barrel extending through an opening in the front sheet of flexible ballistic shield material. The mobile personnel gunfire shield allows a person to move the gunfire shield while protecting the occupant from gunfire and simultaneously allows the operator to operate a gun from thereinside. A flexible skirt extends below the frame base to protect the wheels and feet of a person therein. The frame also includes a pair of kickstands which holds the gunfire shield in position when positioned. The gun mount may have a plurality of gun mounting clamps thereon for movably clamping a rifle or the like to the gun mount and is mounted on a universal mount for aiming and firing the gun. The operator can use the gun mount to push the gunfire shield while maintaining his position for aiming the gun.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
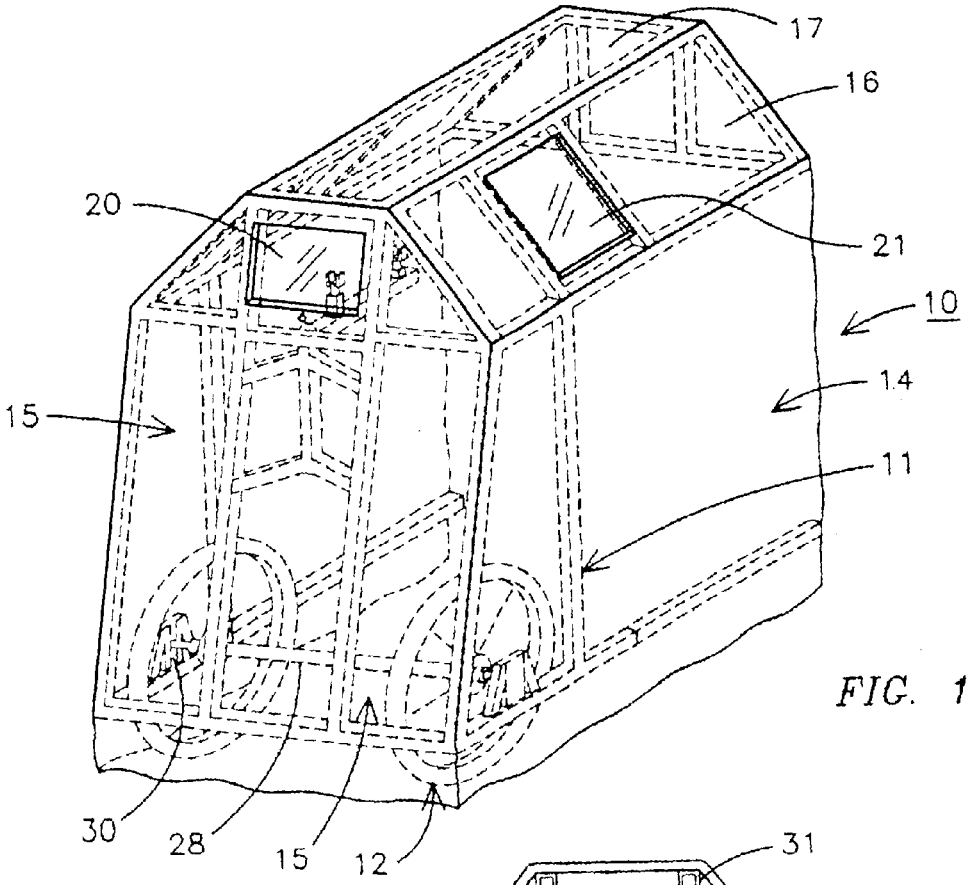
FIG. 1 is a perspective view of a mobile gunfire shield in accordance with the present invention.
Figure 2:
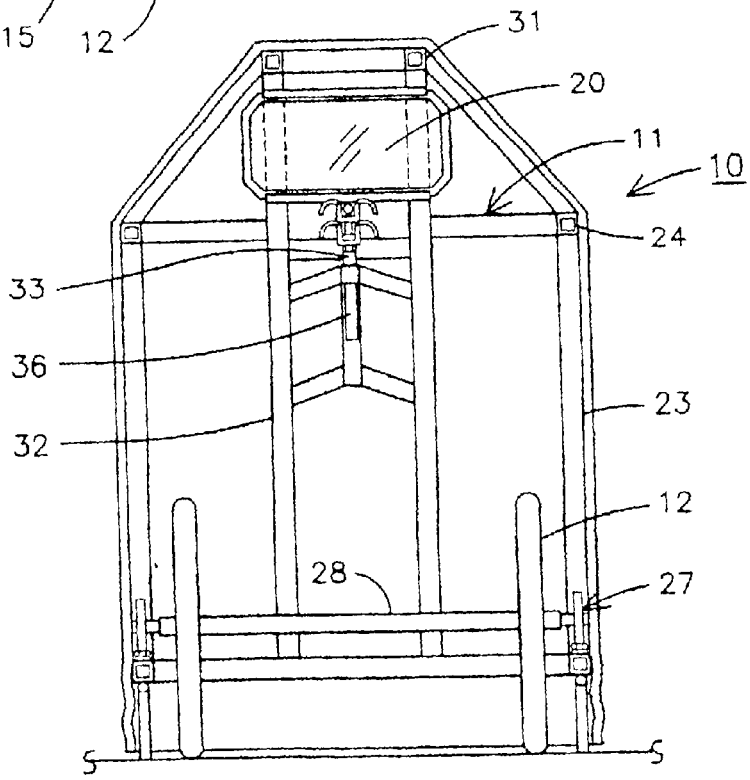
FIG. 2 is a rear sectional view showing the inside of the mobile gunfire shield of FIG. 1.

Referring to the drawings FIGS. 1–5, a mobile personnel gunfire shield 10 is illustrated having a framework 11 which may be formed of any satisfactory material desired, such as steel or aluminum. The frame is supported on large front wheels 12 to allow the frame to be rolled by an individual 13. The frame supports a flexible ballistic shielding material 14 on the sides thereof and shielding material 15 on the front. The shielding material also covers top areas 16 and 17. The flexible shielding material can be a woven Kevlar or similar polymer shield material commonly used in bulletproof vests and is loosely attached to the metal frame 11 so that when a projectile, such as a bullet, hits the material 14 and 15, the material stops the projectile. The material is spaced from the individual which allows the fabric to move or give during the dissipation of the energy from a projectile. A bulletproof glass or polymer window 20 is also mounted in the shield 10. There is also an angled bulletproof top window 21. The bullet resistant glass 20 can slide horizontally in a metal track without exposing an opening. If there is a direct hit, a small portion of the glass will become opaque, preventing sighting of the gun. The operator can easily slide a clear area in front of the scope. The frame includes a bottom rail 22 along with vertical supporting posts 23 and a top side rail 24. The bottom side rail 22 has a hinge 25 with a hinged bottom rail 26 attached thereto. The hinged rail 26 allows the operator to tilt the shield backward in order to shoot up at a target, such as a gunman on the second floor of a building. Bicycle type kickstands 29, one on each bottom rail, allow the shield to remain in a level resting position. In the case of a stand-off that lasts for hours, the operator will have his hands free to use binoculars or a two-way radio. In an instant, the shield can be pushed forward, causing the kickstands to snap up against the bottom rail. A pair of axle supporting brackets support a pair of journals 27 which support the axle 28 and the wheels 12. The axle 28 is the balance point of the shield. Weights can be attached to a shelf area between the axle and the front bottom rail to balance the shield. In this way, the back end of the shield will not need to be lifted because it will be perfectly balanced. The wheel support 27 is adjustable to move the wheels and axle up and down to vary the height of the frame by moving the axle in slots 30 within the journal members 27. The frame 11 also includes top frame members 31 and front frame members 32.

A gun mounting system 33 has a horizontally extending gun supporting bar 34 having a locking ball joint 35 having a locking handle 39 connecting to a push rod support 36. The bar 34 has a push rod handle 37 for pushing the entire mobile shield 10 by the occupant 13. A pair of gun supporting brackets 38 are mounted to the gun supporting and push rod bar 34 which mounts a gun 40 thereto extending through an opening 41 and which may have an optical telescope 42 attached thereto for firing by the occupant 13. Rear supporting frame members 43 support the rear of the mobile shield. The Kevlar or bulletproof shield material 14 and 15 may be extended 44 to just above the surface 45. When the kickstands 29 are down or when the shield is in the extreme backward tilted position, the operator can release the knob 39 and freely move the gun, together with the gun supporting bar 34, without moving the entire shield. For example, the operator could drop to one knee, release the knob 39, and aim the gun at a steep upward angle, or pan the gun from left to right while the shield remains stationary.

Figure 3:
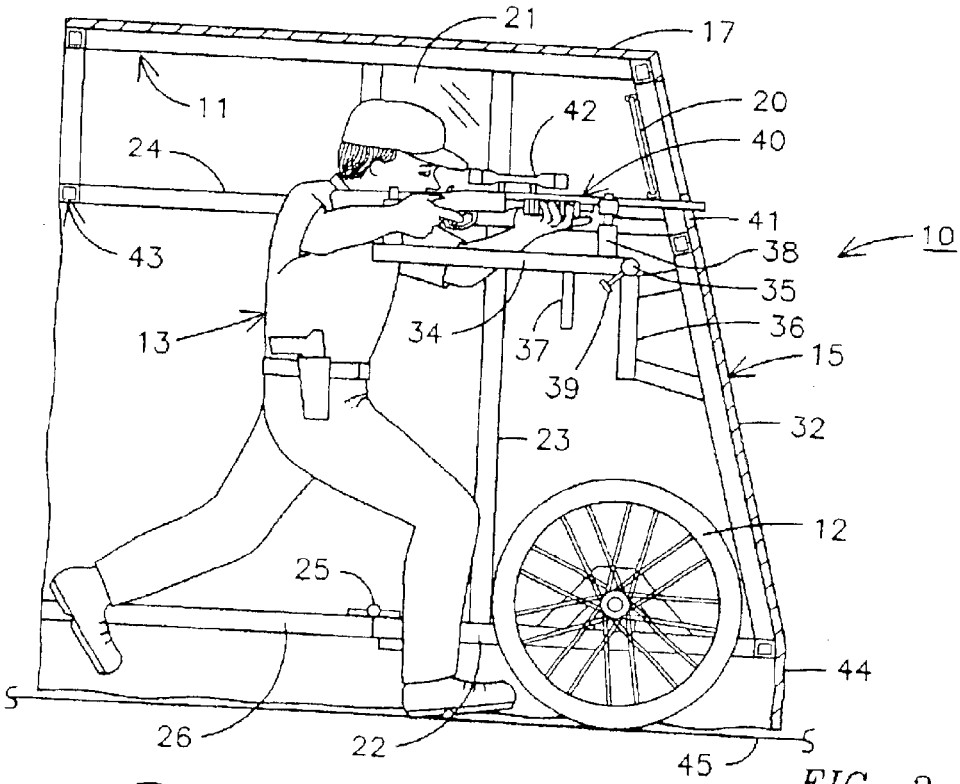
FIG. 3 is a side sectional view of the mobile shield of FIG. 1 having an individual using the shield.
Figure 4:
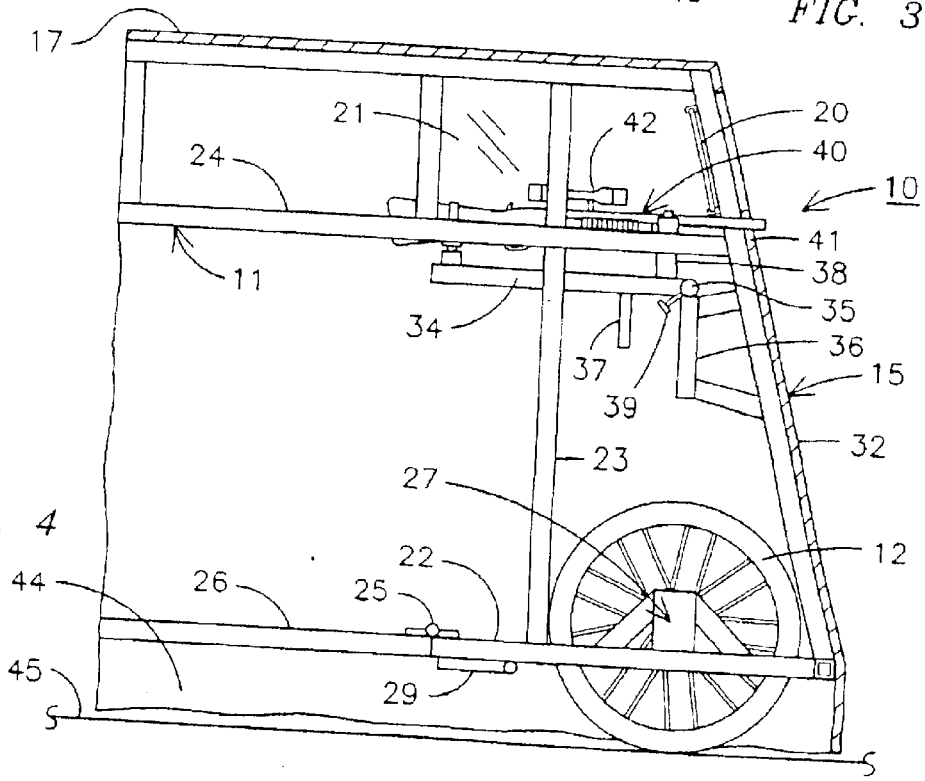
FIG. 4 is another sectional view of the mobile personnel shield of FIGS. 1–3.
Figure 5:
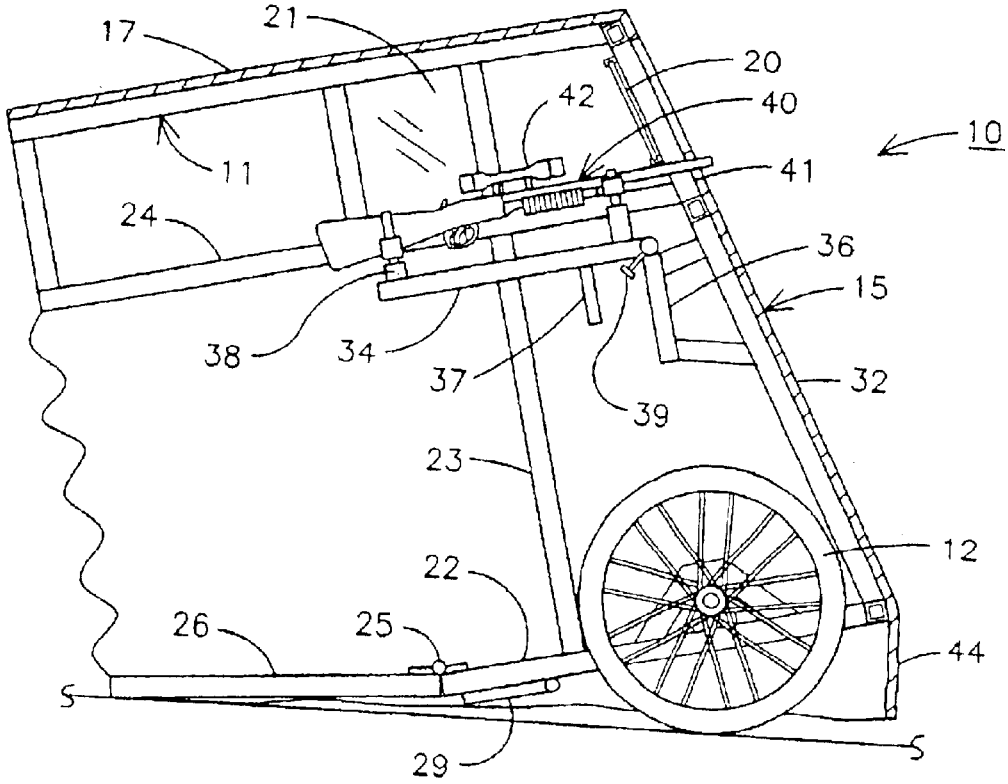
FIG. 5 is a sectional view of the mobile shield of FIGS. 1–4 in a backward tilted position.

The mobile shield is shown in FIG. 5 at rest having a gun 40 mounted to the gun supports 34 and in FIG. 3, an occupant 13 is using the mobile shield 10 as he moves forward having visibility through the bulletproof glass window 20 and having the gun extending through the opening 41. The occupant 13 lifts the rear of the shield 10 to push the shield on wheels 12. The large wheels are especially effective in moving a large mobile shield and readily move over debris or uneven surfaces. The tires on the wheels may be of a bulletproof nature, such as a solid rubber rather than a balloon tire, even though the wheels are shielded by the bulletproof shielding material 14 and 15.

The occupant 13 can move in on riots, mobs, armed fugitives or the like and can move into buildings where armed fugitives are holding out and can return fire from one end of the protective shield system 10 with the rifle 40. The shield is made lightweight by the use of a frame and polymer shielding material, such as used in bulletproof vests. Being mounted away from the occupant 13 allows space for the flexible shielding material 14 and 15 to give or flex and dissipate energy without harming the occupant 13 as would be the case with a bulletproof vest. The mobile shield 10 is easily loaded onto a vehicle and carried from one site to the next as needed by the police, militia, or military.

It should be clear at this time that a mobile personnel shielding device for shielding against small arms fire, shrapnel and other projectiles has been provided which has a metal frame covered with Kevlar or other flexible polymer bullet resistant material and which can be rolled on large wheels. A gun attached to the push rod can be manipulated and fired out of a small opening and there are several plates of bullet resistant glass on the front and sides. However, the present invention should not be construed as limited to the forms shown which are to be considered illustrative rather than restrictive.

What is claimed is:

1. A mobile personnel gunfire shield comprising:

a frame having base, top, front and a plurality of sides;

a plurality of wheels attached to said frame base;

a plurality of sheets of flexible ballistic shield material, each said sheet being attached to said frame to cover the frame front and top and at least one side;

a transparent bullet resistant window mounted to said frame front;

a moveable gun mount mounted to said frame front adjacent said window and having a gun having a barrel removably mounted thereto and having said barrel extending through said front sheet of flexible ballistic shield material; and a flexible skirt attached to and extending below said frame base protecting said wheels;

whereby a mobile personnel gunfire shield allows a person to propel said shield on said plurality of wheels while remaining protected behind said flexible ballistic shield material and being able to operate said movable gun therefrom.

2. The mobile personnel gunfire shield in accordance with claim 1 in which said plurality of sheets of flexible ballistic shield material is removably attached to said frame.

3. The mobile personnel gunfire shield in accordance with claim 2 in which said plurality of wheels includes two wheels.

4. The mobile personnel gunfire shield in accordance with claim 3 including a kick stand mounted to said frame base for resting said frame thereon when not being moved on said wheels.

5. The mobile personnel gunfire shield in accordance with claim 3 including a pair of kick stands mounted to said frame base for resting said frame thereon.

6. The mobile personnel gunfire shield in accordance with claim 4 including an axle attached to said frame base and having said pair of wheels rotatably mounted thereto.

7. The mobile personnel gunfire shield in accordance with claim 6 including a top transparent bullet resistant window mounted to said frame top.

8. The mobile personnel gunfire shield in accordance with claim 7 in which said gun mount is mounted to said frame front and said gun mount having means for pushing thereagainst to propel said gunfire shield on said pair of wheels.

9. The mobile personnel gunfire shield in accordance with claim 1 in which said plurality of sheets of flexible ballistic shield material is made of a Kevlar polymer.

10. The mobile personnel gunfire shield in accordance with claim 9 in which said frame is made of steel.

11. The mobile personnel gunfire shield in accordance with claim 10 in which said moveable gun mount has a pair of gun supporting brackets thereon for removably attaching said gun thereto.

12. The mobile personnel gunfire shield in accordance with claim 11 in which said moveable gun mount is mounted to the frame with a universal joint to allow aiming of said gun mounted thereto.

* * * * *